US011573520B2

(12) United States Patent
Takashima et al.

(10) Patent No.: US 11,573,520 B2
(45) Date of Patent: Feb. 7, 2023

(54) LUBRICANT APPLICATION DEVICE FOR IMAGE FORMING APPARATUS

(71) Applicant: HEWLETT-PACKARD DEVELOPMENT COMPANY, L.P., Spring, TX (US)

(72) Inventors: Koichiro Takashima, Yokohama (JP); Katsushi Higashida, Yokohama (JP); Hiroyuki Sato, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/051,049

(22) PCT Filed: Jun. 21, 2019

(86) PCT No.: PCT/US2019/038497
§ 371 (c)(1),
(2) Date: Oct. 27, 2020

(87) PCT Pub. No.: WO2020/023165
PCT Pub. Date: Jan. 30, 2020

(65) Prior Publication Data

US 2021/0124302 A1 Apr. 29, 2021

(30) Foreign Application Priority Data

Jul. 23, 2018 (JP) ..... JP2018-137961

(51) Int. Cl.
*G03G 21/00* (2006.01)
*G03G 21/16* (2006.01)

(52) U.S. Cl.
CPC ..... *G03G 21/0094* (2013.01); *G03G 21/1671* (2013.01)

(58) Field of Classification Search
CPC ..... G03G 21/0094; G03G 21/00; G03G 21/0035; G03G 15/161; G03G 2221/0005
See application file for complete search history.

(56) References Cited

U.S. PATENT DOCUMENTS

| | | | |
|---|---|---|---|
| 9,081,347 B2 | 7/2015 | Fujimori et al. | |
| 9,632,475 B2 | 4/2017 | Uenishi et al. | |
| 2011/0229232 A1* | 9/2011 | Kojima | G03G 21/0094 399/346 |

(Continued)

FOREIGN PATENT DOCUMENTS

| | | |
|---|---|---|
| JP | 20050062641 | 3/2005 |
| JP | 20060003537 | 1/2006 |

(Continued)

*Primary Examiner* — Jessica L Eley
(74) *Attorney, Agent, or Firm* — Foley & Lardner LLP

(57) ABSTRACT

An image forming apparatus includes a lubricant application target member, an application roller which is provided at a position adjacent to the lubricant application target member to apply a lubricant to the lubricant application target member, a lubricant support member which supports the lubricant, and a movement mechanism which includes a guide coupled to the lubricant support member and extending along a linear direction. An engaging portion engages with the guide and restricts movement of the lubricant support member in a linear direction of the guide by engagement of the guide with the engaging portion.

18 Claims, 6 Drawing Sheets

(56) References Cited

U.S. PATENT DOCUMENTS

| | | | | |
|---|---|---|---|---|
| 2013/0251382 | A1 | 9/2013 | Honjoh | |
| 2017/0102663 | A1 * | 4/2017 | Tomita | G03G 21/1647 |

FOREIGN PATENT DOCUMENTS

| | | | |
|---|---|---|---|
| JP | 2009265586 | A | 11/2009 |
| JP | 20100197856 | | 9/2010 |
| JP | 20120027135 | | 2/2012 |

* cited by examiner

LUBRICANT APPLICATION DEVICE FOR IMAGE FORMING APPARATUS

CROSS REFERENCE TO RELATED APPLICATIONS

This application is filed under 35 U.S.C. § 371 as a National Stage of PCT International Application No. PCT/US2019/038497, filed on Jun. 21, 2019, in the U.S. Patent and Trademark Office, which claims the priority benefit of Japanese Patent Application No. 2018-137961, filed on Apr. 11, 2018, in the Japan Paptent Office. The disclosures of PCT International Application No. PCT/US2019/038497 and Japanese Patent Application No. 2018-137961 are incorporated by reference herein in their entireties.

BACKGROUND

An imaging device may include an image carrier, and a lubricant application device for applying a lubricant to the image carrier. The lubricant application device includes a lubricant application roller for applying the lubricant to the image carrier, and a pressurizing unit for pressurizing and urging the lubricant against the lubricant application roller. The pressurizing unit has a lubricant case for accommodating the lubricant, and a pressurizing spring accommodated in the lubricant case to pressurize the lubricant against the image carrier.

DETAILED DESCRIPTION

Figure 1:
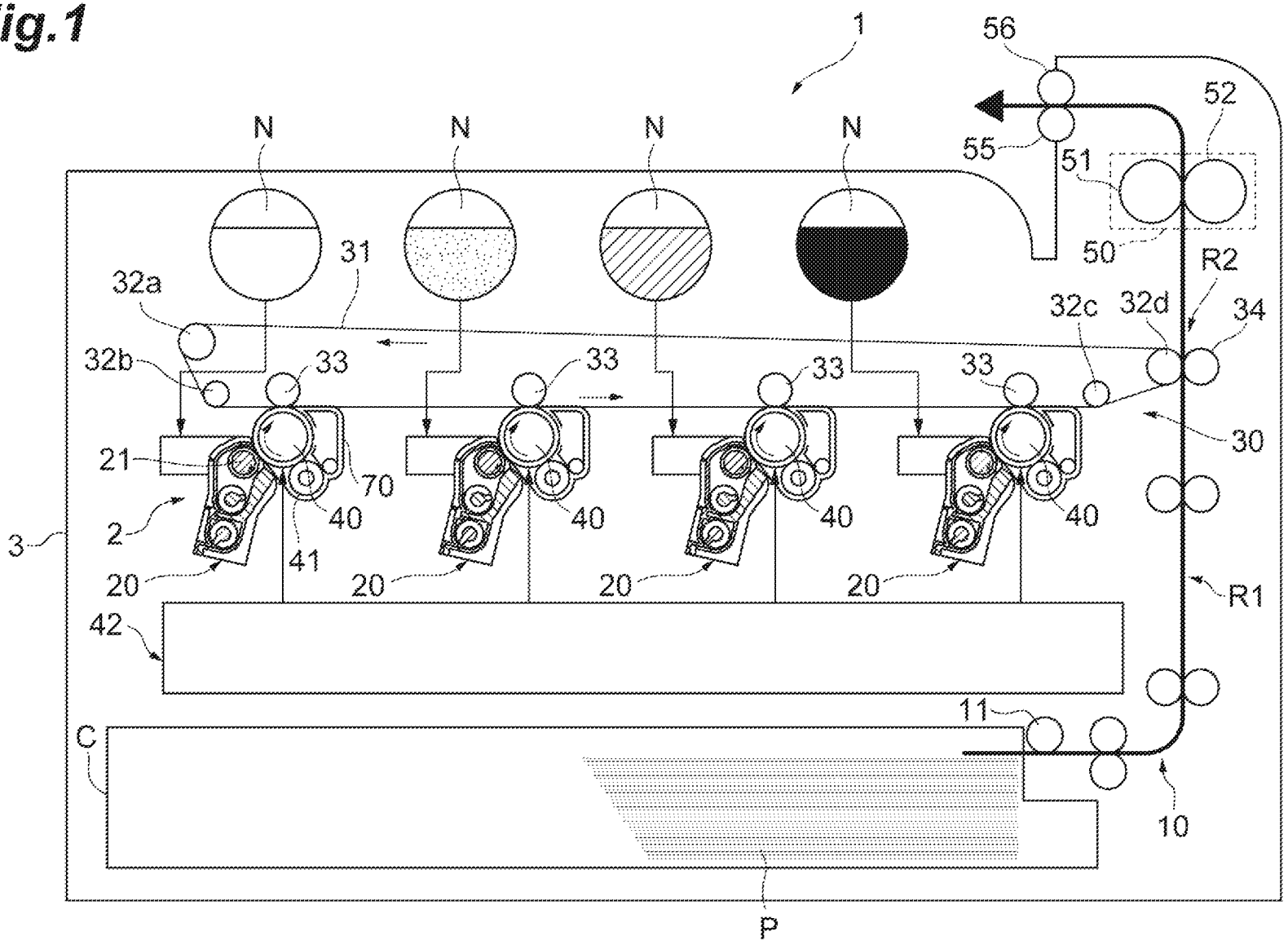
FIG. 1 is a schematic diagram of an example image forming apparatus.

In the following description, with reference to the drawings, the same reference numbers are assigned to the same components or to similar components having the same function, and overlapping description is omitted. In some cases, drawings may be drawn in a simplified or exaggerated manner for the sake of clarity of example.

An example image forming apparatus 1 may include a recording medium conveying device 10, a plurality of developing devices 20, a transfer device 30, an image carrier 40 that is a plurality of photoreceptors, and a fixing device 50. The recording medium conveying device 10 conveys the paper P as a recording medium. The developing device 20 develops an electrostatic latent image. The transfer device 30 secondarily transfers the toner image to the paper P. The image carrier 40 is an image carrier on which an image is formed on its outer circumferential surface. The fixing device 50 fixes a toner image on the paper P. The image forming apparatus 1 may be configured to form a color image, using magenta, yellow, cyan, and black colors. Additionally, the image forming apparatus 1 may be a printer, a component of an imaging system, or an imaging system. For example, the image forming apparatus 1 may comprise a developing device used in an imaging system or the like.

In some examples, the recording medium conveying device 10 includes a paper feeding roller 11 that conveys the paper P on which an image is formed along a conveying path R1. The paper P is stacked and stored in a cassette C, and conveyed by being picked up by the paper feeding roller 11. The paper feeding roller 11 is provided near an exit of the paper P of the cassette C. The recording medium conveying device 10 causes the paper P to reach a secondary transfer region R2 via the conveying path R1 at a timing when the toner image transferred to the paper P reaches the secondary transfer region R2.

A separate developing device 20 may be provided for each color. Each of the developing devices 20 includes a developing roller 21 that causes toner to be carried on the image carrier 40. In the developing device 20, for example, the toner and carrier are adjusted to have a predetermined mixing ratio, and the toner and carrier are mixed and stirred to uniformly disperse the toner. The developer is carried on the developing roller 21. The developing roller 21 rotates to convey the developer to a region facing the image carrier 40. Further, the toner of the developer carried on the developing roller 21 moves to the electrostatic latent image of the image carrier 40, and the electrostatic latent image is developed.

In some examples, the transfer device 30 conveys the toner image formed by the developing device 20 and the image carrier 40 to the secondary transfer region R2. The image developed on the image carrier 40 is transferred to the transfer device 30. As an example, the transfer device 30 includes a transfer belt 31, suspension rollers 32*a*, 32*b*, 32*c*, and 32*d*, a primary transfer roller 33, and a secondary transfer roller 34. The transfer belt 31 is suspended by the suspension rollers 32*a*, 32*b*, 32*c*, and 32*d*. A separate primary transfer roller 33 may be provided for each color. Each primary transfer roller 33 clamps the transfer belt 31 together with each image carrier 40. The secondary transfer roller 34 clamps the transfer belt 31 together with the suspension roller 32*d*.

The transfer belt 31 may include an endless belt that circulates and moves by the suspension rollers 32*a*, 32*b*, 32*c*, and 32*d*. The primary transfer roller 33 presses the image carrier 40 from the inner circumferential side of the transfer belt 31. The secondary transfer roller 34 presses the suspension roller 32*d* from the outer circumferential side of the transfer belt 31. The image carrier 40 includes, for example, a photosensitive drum. In some examples, a separate image carrier 40 is provided for each color. The plurality of image carriers 40 is arranged side by side along a moving direction of the transfer belt 31. A developing device 20, an exposure unit 42, a charging device 41, and a cleaning device 70 are provided at facing positions of the outer circumferential surface of each image carrier 40.

The image forming apparatus 1 may include a process cartridge 2 integrally including the developing device 20, the image carrier 40, the charging device 41 and the cleaning device 70, and an apparatus main body 3 to which the process cartridge 2 is attached and detached. The process cartridge 2 is freely attachable to and detachable from the apparatus main body 3 by opening a door of the apparatus main body 3 and inserting the process cartridge 2 into and extracting the process cartridge 2 from the apparatus main body 3.

In some examples, the charging device 41 uniformly charges the outer circumferential surface of the image carrier 40 to a predetermined potential. The charging device 41 may include a charging roller that rotates to follow the rotation of the image carrier 40. The exposure unit 42 exposes the outer circumferential surface of the image carrier 40 charged by the charging device 41 in accordance with the image to be formed on the paper P. The potential of a portion of the outer circumferential surface of the image carrier 40 exposed to the exposure unit 42 changes, and the electrostatic latent image is formed on the outer circumferential surface of the image carrier 40 accordingly.

In some examples, toner is supplied to each of the plurality of developing devices 20 from each of a plurality of toner tanks N disposed to face each of the developing devices 20. Each of the developing devices 20 develops the electrostatic latent image of each image carrier 40 with the supplied toner. As a result, the toner image is developed. The developing device 20 and the toner tank N may include toner supply units that supply toner to the image carrier 40. For example, magenta, yellow, cyan, and black toners are separately contained in each toner tank N. The cleaning device 70 removes the toner remaining on the outer circumferential surface of the image carrier 40 after the toner image formed on the outer circumferential surface of the image carrier 40 is initially transferred to the transfer belt 31. The cleaning device 70 will be described in further detail later.

The fixing device 50 fixes the toner image, which was secondarily transferred to the paper P from the transfer belt 31, onto the paper P. The fixing device 50 includes, for example, a fixing belt 51 that heats the paper P and fixes the toner image onto the paper P, and a pressure roller 52 that pressurizes the fixing belt 51. In some examples, the fixing belt 51 and the pressure roller 52 are formed in a cylindrical shape. Additionally, a heat source such as a halogen lamp may be provided inside the fixing belt 51. A fixing nip portion, which is a contact region, is provided between the fixing belt 51 and the pressure roller 52. As the paper P passes through the fixing nip portion, the toner image is melted and fixed onto the paper P. Also, the image forming apparatus 1 may be provided with discharge rollers 55 and 56 which discharge the paper P, on which the toner image has been fixed by the fixing device 50, to the outside of the image forming apparatus 1.

Next, an example image forming method will be described. The image forming method may comprise a printing process performed by the image forming apparatus 1. For example, when an image signal of an image to be recorded is input to the image forming apparatus 1, the paper P stacked on the cassette C is picked up by the rotation of the paper feeding roller 11, and the paper P is conveyed along the conveying path R1. Then, the charging device 41 uniformly charges the outer circumferential surface of the image carrier 40 to a predetermined potential on the basis of the image signal. Thereafter, the exposure unit 42 irradiates the laser beam onto the outer circumferential surface of the image carrier 40 to form an electrostatic latent image on the outer circumferential surface of the image carrier 40.

Subsequently, the developing device 20 forms a toner image on the image carrier 40 and performs development. In some examples, the toner image is initially transferred from each image carrier 40 to the transfer belt 31 in a region in which the image carrier 40 and the transfer belt 31 face each other. Additionally, toner images formed on each of the plurality of image carriers 40 may be sequentially superimposed on the transfer belt 31 to form a composite toner image. The composite toner image is secondarily transferred to the paper P conveyed from the recording medium conveying device 10 in the secondary transfer region R2 in which the suspension roller 32*d* and the secondary transfer roller 34 face each other.

The paper P to which the composite toner image is secondarily transferred is conveyed from the secondary transfer region R2 to the fixing device 50. The fixing device 50 melts and fixes the composite toner image on the paper P by, for example, causing the paper P to pass through the fixing nip portion, while applying heat and pressure to the paper P. Thereafter, the paper P is discharged to the outside of the image forming apparatus 1 by the discharge rollers 55 and 56.

Figure 2:
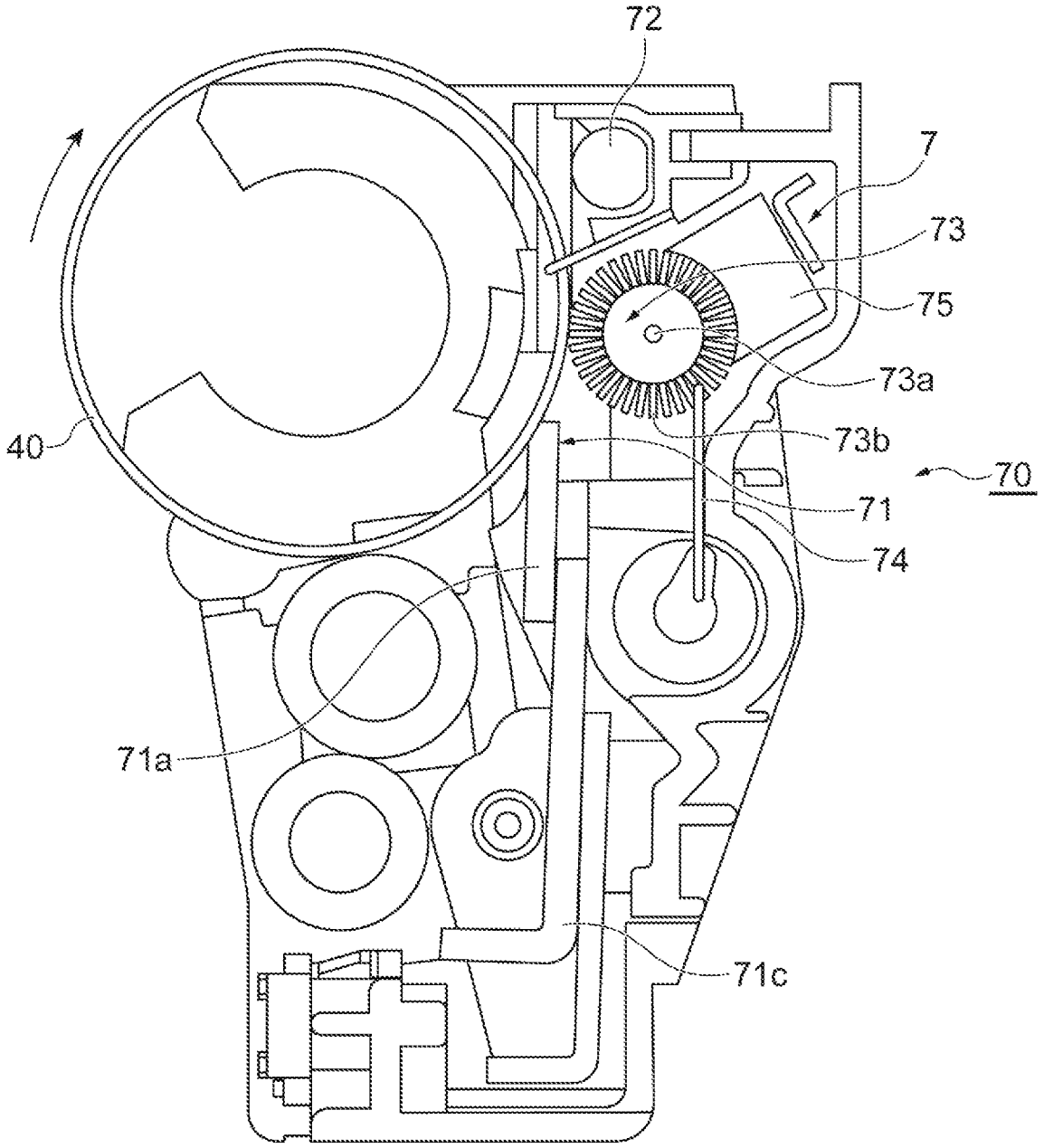
FIG. 2 is a view illustrating an example image carrier.

FIG. 1 illustrates a cleaning device 70 that comes into contact with the outer circumferential surface of the image carrier 40. As illustrated in FIG. 2 with further detail, the example cleaning device 70 includes a cleaning blade 71 that comes into contact with the outer circumferential surface of the image carrier 40, and an eraser 72 that is provided on an upstream side of the cleaning blade 71 in a rotational direction of the image carrier 40. The eraser 72 irradiates the electrostatic latent image formed on the outer circumferential surface of the image carrier 40 with a beam to remove the electrostatic charge of the image carrier 40 and to erase the image information of the image carrier 40.

The cleaning blade 71 includes, for example, a base material 71*a* and a support 71*c* that supports the base material 71*a*. An end portion of the base material 71*a* is fixed to the support 71*c*. The base material 71*a* may have a strip shape. In some examples, the length of the base material 71*a* is 220 mm or more and 360 mm or less, and the width of the base material 71*a* is 5 mm or more and 15 mm or less. Additionally, the thickness of the base material 71*a* may be 1.6 mm or more and 2.4 mm or less. The material of the base material 71*a* may include an elastic body such as rubber or a thermoplastic elastomer. The material of the support 71*c* may include a metal such as iron, copper, stainless steel, aluminum, aluminum alloy or nickel.

The image forming apparatus 1 may be equipped with a lubricant application device 7 that applies the lubricant 75 to the image carrier 40. The image carrier 40 is an example of a lubricant application target member to which the lubricant 75 is applied. By applying the lubricant 75 to the image carrier 40, the lubricant application device 7 suppresses wear of the image carrier 40 and enhances transferability of an intermediate transfer. The lubricant application device 7 includes an application roller 73 positioned between the cleaning blade 71 and the eraser 72 in the rotational direction of the image carrier 40. The application roller 73 is provided at a position adjacent to the image carrier 40. The application roller 73 removes and holds at least a part of the toner remaining on the outer circumferential surface of the image carrier 40 from the image carrier 40.

The application roller 73 may include a brush roller. The application roller 73 includes, for example, a metal shaft portion 73*a* and a brush 73*b* fixed to the shaft portion 73*a*. Additionally, the application roller 73 may be conductive. The shaft portion 73*a* extends in a direction in which the rotation axis of the image carrier 40 extends. The shaft portion 73*a* may include a base fabric in which the brush 73*b* is implanted as a plurality of bristles. In some examples, when the brush 73*b* is implanted on the outer circumferential surface of the shaft portion 73*a*, each brush 73*b* is fixed to the shaft portion 73*a*. The material of the brush 73*b* may include an acrylic fiber, a nylon fiber or a PET fiber.

In some examples, the thickness of the brush 73*b* is 3 denier or more and 6 denier or less. Additionally, the density of the brush 73*b* may be between approximately 50K lines/inch to 200K lines/inch, the length of the brush 73*b* may be between approximately 10 mm to 20 mm, and the length of the bristle implanted to the shaft portion 73*a* may be between approximately 2 mm to 5 mm. The electric resistivity of the brush 73*b* when a voltage of 500 V is applied to the application roller 73 may be approximately $10\times10^{12}$ [Ω·cm] or less.

The application roller 73 may rotate in a direction in which the application roller 73 follows the image carrier 40, for example in a counterclockwise direction in FIG. 2. A flicker 74 for scraping off the toner adhering to the brush 73*b* comes into contact with the brush 73*b* of the application roller 73. The flicker 74 may be formed in a plate shape. The flicker 74 may be provided at a position at which the flicker 74 bites into the rotationally moving brush 73*b*. In some examples, as the brush 73*b* rotationally moves, the toner of the brush 73*b* is scraped off by the flicker 74.

The lubricant 75 forming a solid lubricated molded body is supported on the side of the application roller 73 opposite to the image carrier 40. In some examples, the lubricant 75 suppresses abrasion of the outer circumferential surface of the image carrier 40 by being applied to the image carrier 40, thereby prolonging the life expectancy of the image carrier 40. The application roller 73 applies the lubricant 75 to the image carrier 40. For example, the application roller 73 scrapes off the lubricant 75 and supplies the lubricant 75 to the image carrier 40. The lubricant 75 may include a metal soap. In some examples, the lubricant 75 may include a material containing zinc stearate.

Figure 3:
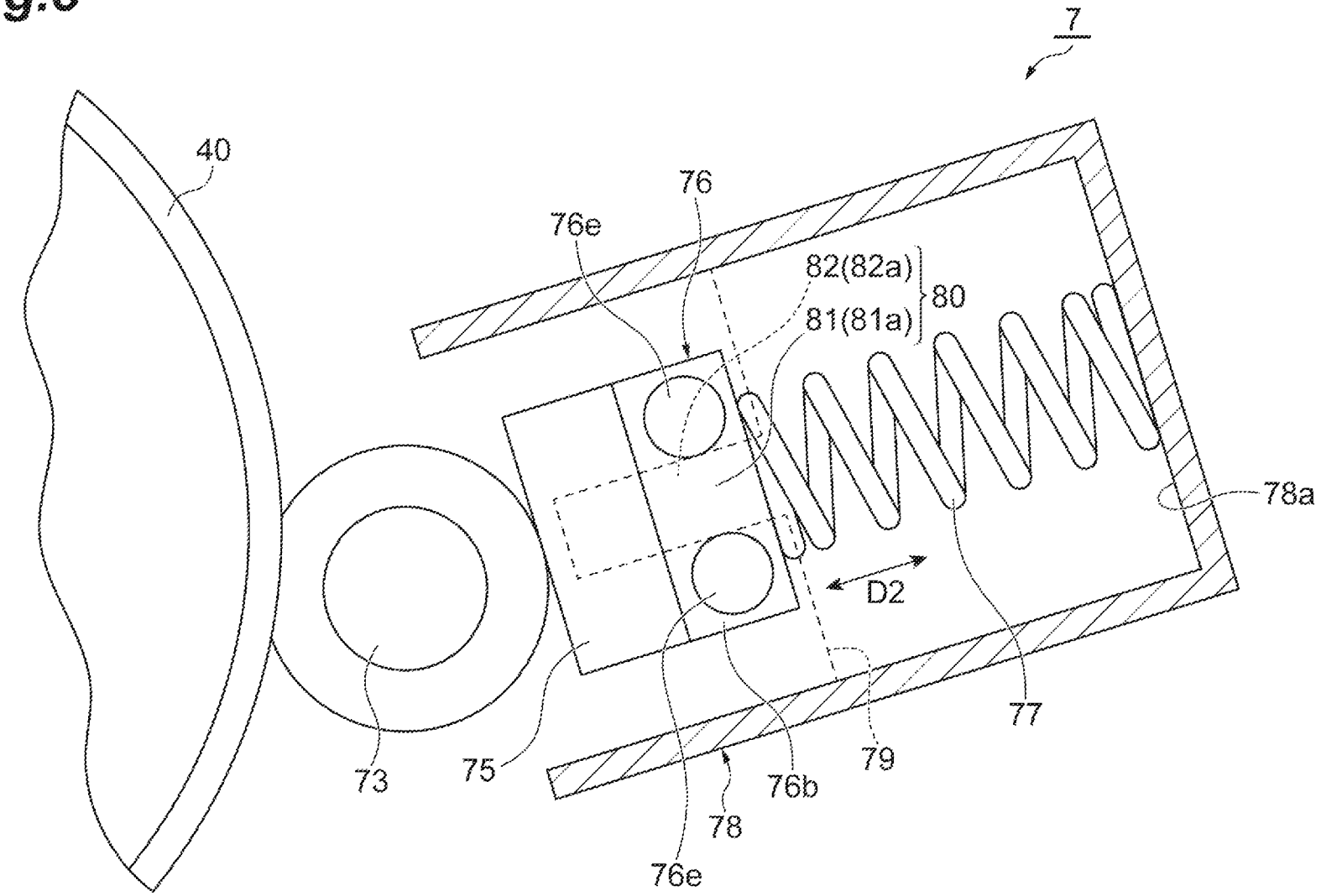
FIG. 3 is a cross-sectional view illustrating an example lubricant application device.
Figure 4:
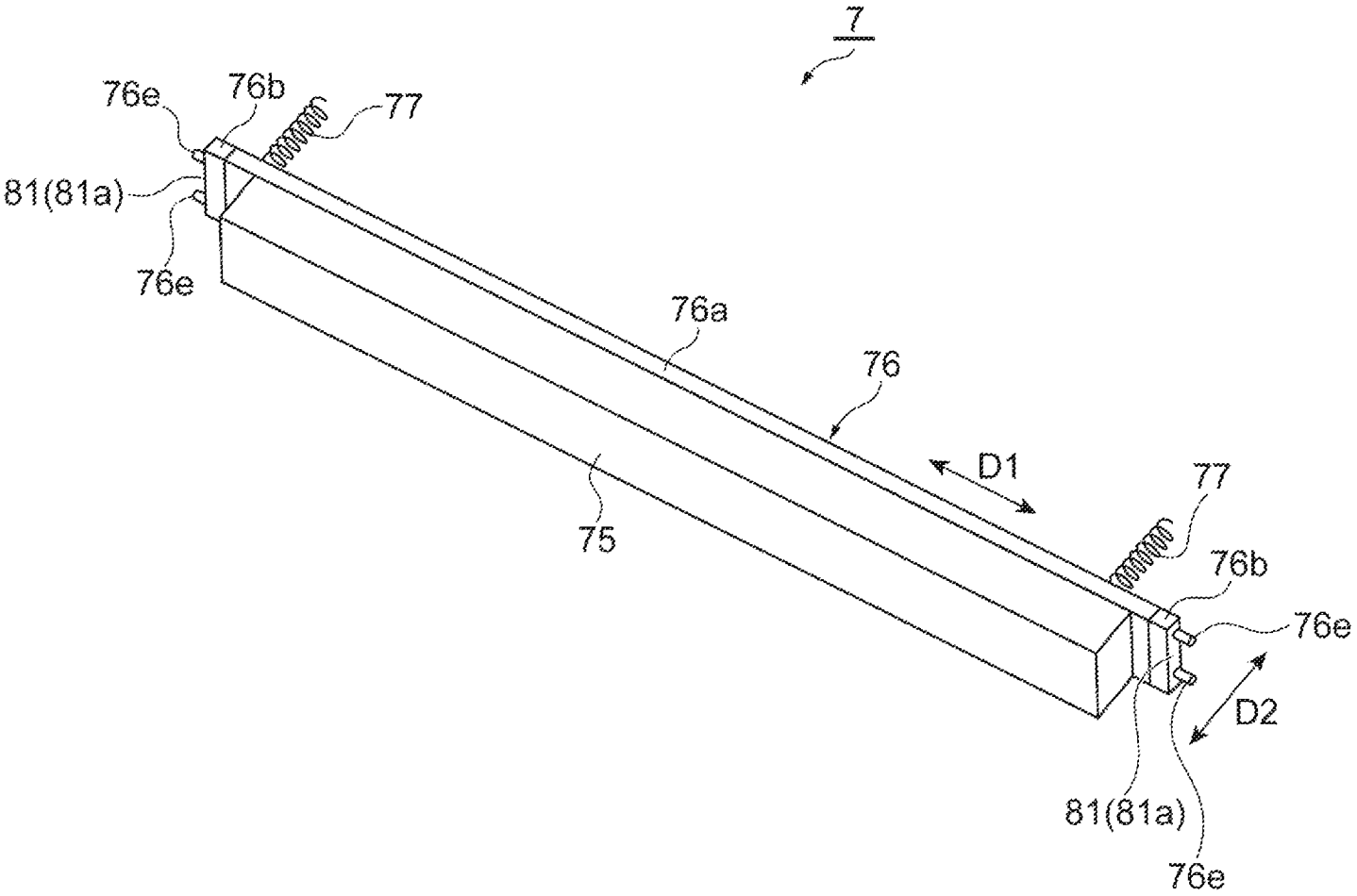
FIG. 4 is a perspective view illustrating the lubricant application device of FIG. 3.

As illustrated in FIGS. 3 and 4, the lubricant application device 7 may include a lubricant support member 76 which supports the lubricant 75, an urging member 77 which pressurizes the lubricant 75 to bring the application roller 73 into contact with the image carrier 40, and a casing 78. FIG. 3 is a diagram illustrating an example arrangement of the application roller 73, the lubricant 75, the lubricant support member 76, the urging member 77, and the casing 78. FIG. 4 is a perspective view illustrating the lubricant 75, the lubricant support member 76, and the urging member 77.

The lubricant support member 76 may be provided at a position that supports the lubricant 75 between the lubricant support member 76 and the application roller 73. In some examples, the lubricant support member 76 is provided on an opposite side of the application roller 73 as seen from the lubricant 75. The lubricant support member 76 may be located between the urging member 77 and the application roller 73. In some examples, the lubricant support member 76 includes a lubricant metal plate 76*a* to which the lubricant 75 is fixed, and a guide member 76*b* which restricts the moving direction of the lubricant metal plate 76*a*.

The guide member 76*b* may be a separate body from the lubricant metal plate 76*a*, but may be integrated with the lubricant metal plate 76*a*. The lubricant metal plate 76*a* supports the lubricant 75 from the side opposite to the application roller 73. In some examples, the lubricant 75 and the lubricant support member 76 both have an elongated shape extending in the direction in which the rotation axis of the application roller 73 extends, and the lubricant metal plate 76*a* is arranged along the lubricant 75.

The longitudinal direction of the lubricant 75 may coincide with a direction D1 which is the longitudinal direction of the lubricant metal plate 76*a*. The shape of the lubricant metal plate 76*a* as seen from the direction D1 may be in the form of an L shape or other type of shape. The plurality of urging members 77 may be arranged to align along the direction D1. In some examples, the urging member 77 is provided at each of both end portions of the lubricant support member 76 in the direction D1. The pair of urging members 77 may be disposed at a position symmetrical with each other with respect to the center of the direction D1 of the lubricant support member 76.

Figure 5:
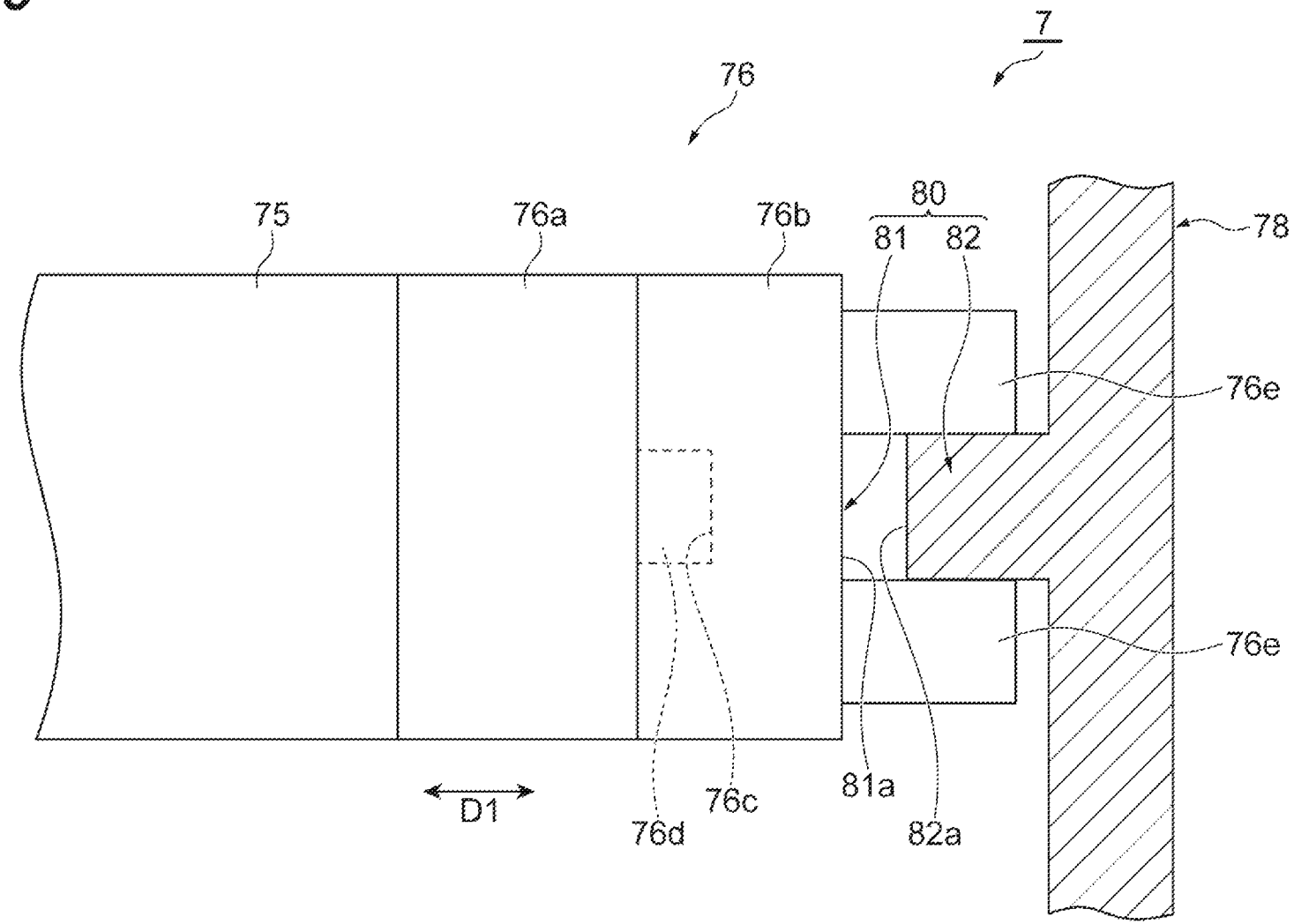
FIG. 5 is a partial cross-sectional view illustrating the example lubricant application device of FIG. 3 as seen from the application roller.

FIG. 5 is a partial sectional view illustrating the lubricant metal plate 76*a*, the guide member 76*b*, and the casing 78. As illustrated in FIGS. 3 to 5, example guide members 76*b* are provided at both end portions of the lubricant metal plate 76*a* in the direction D1, respectively. The lubricant metal plate 76*a* has a protrusion 76*d* that fits into a hole portion 76*c* formed in the guide member 76*b*. In some examples, the guide member 76*b* is connected to the lubricant metal plate 76*a* by fitting the protrusion 76*d* into the hole portion 76*c*. However, a configuration for connecting the lubricant metal plate 76*a* and the guide member 76*b* to each other can be changed as appropriate.

The casing 78 accommodates, for example, the lubricant 75, the lubricant support member 76, and the urging member 77. In some examples, the casing 78 has a box shape. The urging member 77 may include a compression coil spring. However, the urging member 77 may be an urging member other than the compression coil spring, and may urge the lubricant support member 76 toward the image carrier 40 by the own weight of the lubricant support member 76. In some examples, the center of gravity of the lubricant support member 76 is provided above the application roller 73, and the lubricant support member 76 may be urged toward the application roller 73 and the image carrier 40 by gravity. In this case, the urging member 77 as the compression coil spring can be omitted.

When the urging member 77 includes a compression coil spring, one end of the urging member 77 may be fixed to a bottom surface 78*a* of the casing 78, and the other end of the urging member 77 may be fixed to the lubricant metal plate 76*a*. The urging member 77 has, for example, an urging force which urges the lubricant support member 76 toward the image carrier 40 and presses the lubricant 75 against the application roller 73 and the image carrier 40.

The lubricant application device 7 may be equipped with a movement mechanism 80 which includes a guide 81 connected to the lubricant support member 76 and extending along the linear direction D2, and an engaging portion 82 which engages with the guide 81. The linear direction D2 may include a direction approaching the image carrier 40 and a direction separating from the image carrier 40. Additionally, a separate guide 81 may be provided at both end portions of the lubricant support member 76 in the direction D1.

In some examples, the guide 81 has a concave portion 81*a* formed for the lubricant support member 76, and the engaging portion 82 has a convex portion 82*a* that protrudes from the casing 78 to the concave portion 81*a*. The concave portion 81*a* may be provided between the plurality of protrusions 76*e* protruding along the direction D1 in the guide member 76*b*. Each of the plurality of protrusions 76*e* has, for example, a columnar shape. Each of the plurality of protrusions 76e may have a prismatic shape, and the shape of the protrusion 76*e* may be appropriately changed. The convex portion 82*a* may have a rectangular shape extending along the linear direction D2.

The lubricant application device 7 may include a restricting portion 79 that restricts movement of the lubricant 75 in the linear direction D2. In some examples, the lubricant application device 7 may be provided outside the image forming apparatus 1, and when the lubricant application device 7 is vibrated or dropped during transportation or the like, the restricting portion 79 may suppress vibration of the lubricant 75 to prevent breakage of the lubricant 75.

The movement mechanism 80 may be located between the lubricant support member 76 and the casing 78. In some examples, the casing 78 is coupled to the movement mechanism 80, and the urging member 77 is disposed between the casing 78 and the lubricant support member 76. With the aforementioned movement mechanism 80, the urging member 77 restricts the movement of the lubricant 75 and the lubricant support member 76 in the linear direction D2.

Figure 6:
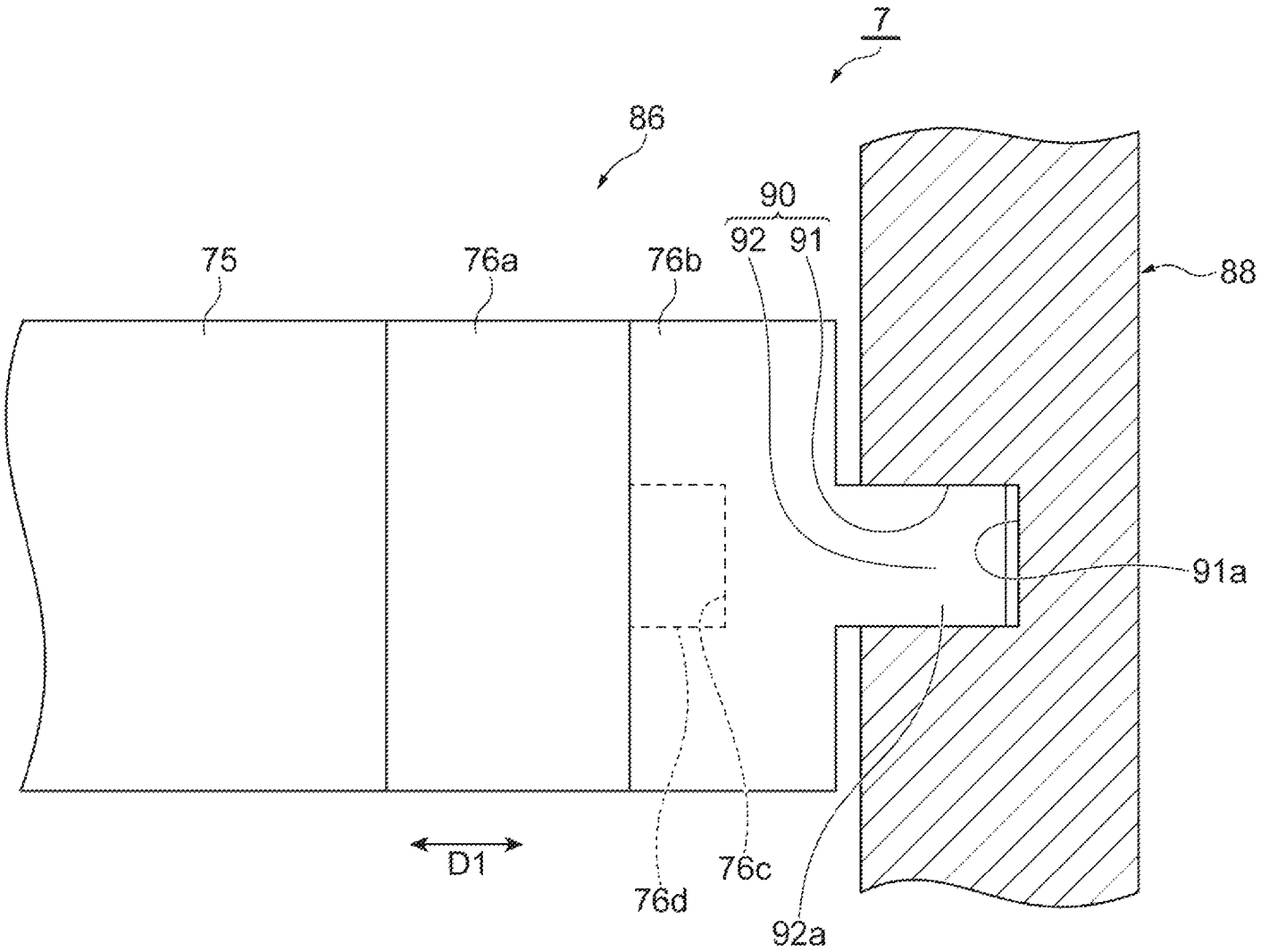
FIG. 6 is a partial cross-sectional view illustrating another example lubricant application device as seen from the application roller.

FIG. 6 is a diagram illustrating another example of the lubricant support member, the casing, and the movement mechanism which differs from FIG. 5. For example, a guide 91 of the movement mechanism 90 has a concave portion 91*a* formed in the casing 88, and an engaging portion 92 of the movement mechanism 90 has a convex portion 92*a* formed on the lubricant support member 86. In some examples, since the convex portion 92*a* of the lubricant support member 86 fits into the concave portion 91*a* of the casing 88, the movement of the lubricant support member 86 is restricted in the linear direction D2. Additionally, the concave portion 91*a* and the convex portion 92*a* may both have a rectangular shape extending in the linear direction D2.

In some examples, the urging member 77 restricts the moving direction of the lubricant support members 76 and 86 in the linear direction D2 by the movement mechanisms 80 and 90. As a result, the lubricant 75 moves along the linear direction D2 and the inclination of the lubricant 75 in the direction other than the linear direction D2 is suppressed. Accordingly, the rotation and the unsteadiness or wobbling of the lubricant 75 caused by the rotation of the application roller 73 may be suppressed. Still further, the lubricant 75 can be applied to the image carrier 40 without waste. Therefore, the life of the lubricant 75 can be prolonged without increasing the size of the lubricant 75, and excess consumption of the lubricant 75 can be reduced.

In some examples, the guides 81 and 91 have concave portions 81*a* and 91*a* formed in one of the lubricant support members 76 and 86 and the casings 78 and 88, and the engaging portions 82 and 92 have convex portions 82*a* and 92*a* formed on the other of the lubricant support members 76 and 86 and the casings 78 and 88. Therefore, the configurations of the guides 81 and 91 and the engaging portions 82 and 92 can be set to a simple configuration having the concave portions 81*a* and 91*a* and the convex portions 82*a* and 92*a*. Further, each of the plurality of protrusions 76*e* may have a cylindrical shape. Therefore, in the guide 81 located between the plurality of protrusions 76*e*, the engaging portion 82 can be smoothly moved in the linear direction D2.

In addition to the above-described example lubricant application devices for applying lubricant 75 to the image carrier 40, the lubricant application device may be, for example, a device that applies the lubricant to the transfer belt 31. In some examples, if the lubricant application device comes into contact with the transfer belt 31 at a position between the suspension roller 32*d* and the suspension roller 32*b* in the moving direction of the transfer belt 31, there may not be any influence on the toner image on the transfer belt 31, and the transferability and the life of the transfer belt unit may be improved.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. An image forming apparatus comprising:

a lubricant application target member;

an application roller which is provided at a position adjacent to the lubricant application target member to apply a lubricant to the lubricant application target member;

a lubricant support member having an elongated shape extending in a longitudinal direction of the lubricant to support the lubricant;

a casing; and a movement mechanism located between the casing and the lubricant support member, the movement mechanism provided at both end portions of the lubricant support member in the longitudinal direction to extend along a linear direction of urging of the lubricant support member towards the lubricant application target member, the movement mechanism including, a guide coupled to the lubricant support member, and an engaging portion coupled to the casing to engage with the guide to restrict movement of the lubricant support member in the linear direction of the guide by engagement of the guide with the engaging portion.

2. The image forming apparatus according to claim 1, comprising:

an urging member to urge the lubricant support member toward the lubricant application target member.

3. The image forming apparatus according to claim 2, comprising:

wherein the urging member is disposed between the casing and the lubricant support member.

4. The image forming apparatus according to claim 2, wherein the urging member comprises a compression coil spring, and the lubricant support member is disposed between the urging member and the application roller.

5. The image forming apparatus according to claim 2, wherein the urging member is provided at both end portions of the lubricant support member in the longitudinal direction.

6. The image forming apparatus according to claim 1, wherein the guide includes a concave portion, and the engaging portion includes a convex portion protruding from an inner surface of the casing to engage the concave portion of the guide.

7. The image forming apparatus according to claim 6, wherein the concave portion is provided between a plurality of protrusions, and a protrusion, among the plurality of protrusions, has a cylindrical shape protruding towards the inner surface of the casing.

8. The image forming apparatus according to claim 6, wherein the concave portion is provided between a plurality of protrusions, and a protrusion, among the plurality of protrusions has a prismatic shape protruding towards the inner surface of the casing.

9. The image forming apparatus according to claim 1, wherein the guide includes a concave portion formed in the casing, and the engaging portion includes a convex portion protruding from the lubricant support member to the concave portion.

10. The image forming apparatus according to claim 1, wherein the lubricant support member is provided at a position which supports the lubricant between the lubricant support member and the application roller.

11. The image forming apparatus according to claim 1, comprising:

a restricting portion to restrict movement of the lubricant in the linear direction.

12. The image forming apparatus according to claim 1, wherein the lubricant support member is urged to the application roller and the lubricant application target member by gravity.

13. The image forming apparatus according to claim 1, wherein the lubricant support member includes a lubricant metal plate to which the lubricant is fixed, and a guide member to restrict a moving direction of the lubricant metal plate, and the guide member is coupled to the guide.

14. A lubricant application device, comprising:

a lubricant support member having an elongated shape extending in a longitudinal direction of the lubricant to support a lubricant to apply the lubricant to the lubricant application target member through an application roller;

a casing; and a movement mechanism located between the casing and the lubricant support member, the movement mechanism provided at both end portions of the lubricant support member in the longitudinal direction to extend along a linear direction of urging of the lubricant support member towards the lubricant application target member, the movement mechanism including, a guide coupled to the lubricant support member, and an engaging portion coupled to the casing to engage with the guide to restrict movement of the lubricant support member in the linear direction of the guide by engagement of the guide with the engaging portion.

15. The lubricant application device according to claim 14, comprising:

an urging member to urge the lubricant support member toward the lubricant application target member.

16. The lubricant application device according to claim 14, wherein the guide includes a concave portion, and the engaging portion includes a convex portion protruding from an inner surface of the casing to engage the concave portion of the guide.

17. The lubricant application device according to claim 16, wherein the concave portion is provided between a plurality of protrusions, and a protrusion, among the plurality of protrusions, has at least one shape from among shapes of a cylindrical shape protruding towards the inner surface of the casing, or a prismatic shape protruding towards the inner surface of the casing.

18. The lubricant application device according to claim 14, wherein the guide includes a concave portion formed in the casing, and the engaging portion includes a convex portion protruding from the lubricant support member to the concave portion.

* * * * *